US006192998B1

(12) United States Patent
Pinckard

(10) Patent No.: US 6,192,998 B1
(45) Date of Patent: Feb. 27, 2001

(54) METHOD OF AND SYSTEM FOR OPTIMIZING RATE OF PENETRATION IN DRILLING OPERATIONS

(75) Inventor: Mitchell D. Pinckard, Lafayette, LA (US)

(73) Assignee: Noble Drilling Services, Inc., Sugar Land, TX (US)

( * ) Notice: Subject to any disclaimer, the term of this patent is extended or adjusted under 35 U.S.C. 154(b) by 0 days.

(21) Appl. No.: 09/484,478

(22) Filed: Jan. 18, 2000

Related U.S. Application Data

(63) Continuation of application No. 09/053,955, filed on Apr. 2, 1998, now Pat. No. 6,026,912, which is a continuation-in-part of application No. 09/158,338, filed on Sep. 22, 1998

(60) Provisional application No. 60/059,794, filed on Sep. 23, 1997.

(51) Int. Cl.[7] ..... E21B 7/00

(52) U.S. Cl. ..... 175/27; 175/57; 175/94

(58) Field of Search ..... 175/24, 40, 27, 175/57, 94, 137

(56) References Cited

U.S. PATENT DOCUMENTS

| | | | | |
|---|---|---|---|---|
| 2,688,871 | | 9/1954 | Lubinski | 73/151.5 |
| 3,777,560 | | 12/1973 | Guignard | 73/151.5 |
| 3,802,259 | | 4/1974 | Eckels | 73/153 |
| 3,872,932 | | 3/1975 | Gosselin | 175/26 |
| 3,881,695 | | 5/1975 | Joubert | 254/172 |
| 3,882,474 | | 5/1975 | Cain | 340/177 |
| 4,354,233 | | 10/1982 | Zhukovsky et al. | 364/420 |
| 4,535,972 | | 8/1985 | Millheim et al. | 254/277 |
| 4,736,297 | | 4/1988 | Lejeune | 364/420 |
| 4,793,421 | | 12/1988 | Jasinski | 175/27 |
| 4,843,875 | | 7/1989 | Kerbart | 73/151.5 |
| 4,875,530 | | 10/1989 | Frink et al. | 175/27 |
| 4,876,886 | | 10/1989 | Bible et al. | 73/151.5 |
| 4,886,129 | | 12/1989 | Bourdon | 175/40 |
| 5,216,917 | * | 6/1993 | Detournay | 73/151 |
| 5,398,546 | | 3/1995 | Jeffryes | 73/151.5 |
| 5,449,047 | | 9/1995 | Schivley, Jr. | 175/27 |
| 5,458,207 | | 10/1995 | Mattero | 175/27 |
| 5,474,142 | | 12/1995 | Bowden | 175/27 |
| 5,551,286 | | 9/1996 | Booer | 73/152.45 |
| 5,730,234 | | 3/1998 | Putot | 175/50 |
| 6,026,912 | * | 2/2000 | King et al. | 175/27 |

* cited by examiner

*Primary Examiner*—Roger Schoeppel
(74) *Attorney, Agent, or Firm*—Pillsbury, Madison, & Sutro, LLP

(57) ABSTRACT

A method of and system for optimizing bit rate of penetration while drilling substantially continuously determine an optimum weight on bit necessary to achieve an optimum bit rate of penetration based upon measured conditions and maintains weight on bit at the optimum weight on bit. As measured conditions change while drilling, the method updates the determination of optimum weight on bit.

19 Claims, 6 Drawing Sheets

FIG. 4
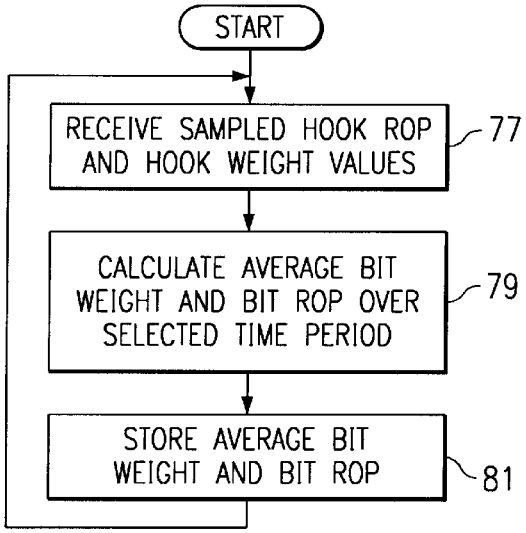
FIG. 5
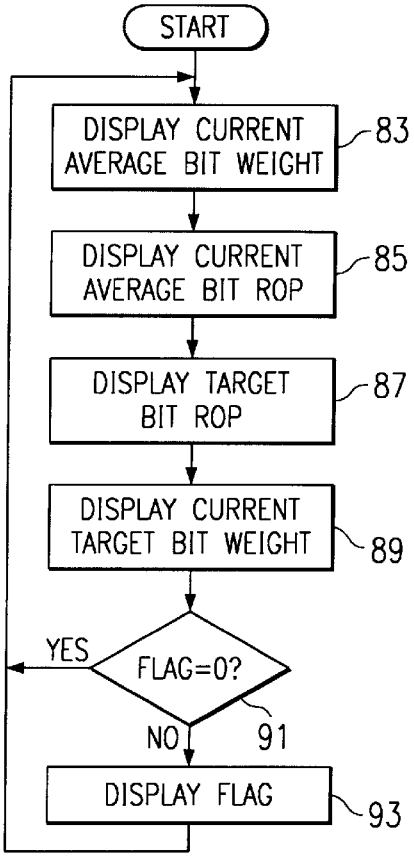
FIG. 7
| 99 | 101 | 103 | 105 | 107 |
|---|---|---|---|---|
| INDEX | BIT_WT(t) | BIT_ROP(t) | BIT_ROP(t−1) | BIT_ROP(t−2) |
| 1 | 23 | 47 | 48 | 49 |
| 2 | 24 | 48 | 49 | 46 |
| 3 | 26 | 49 | 46 | 45 |
| ⋮ | ⋮ | ⋮ | ⋮ | ⋮ |
| 30 | 24 | 48 | 46 | 45 |

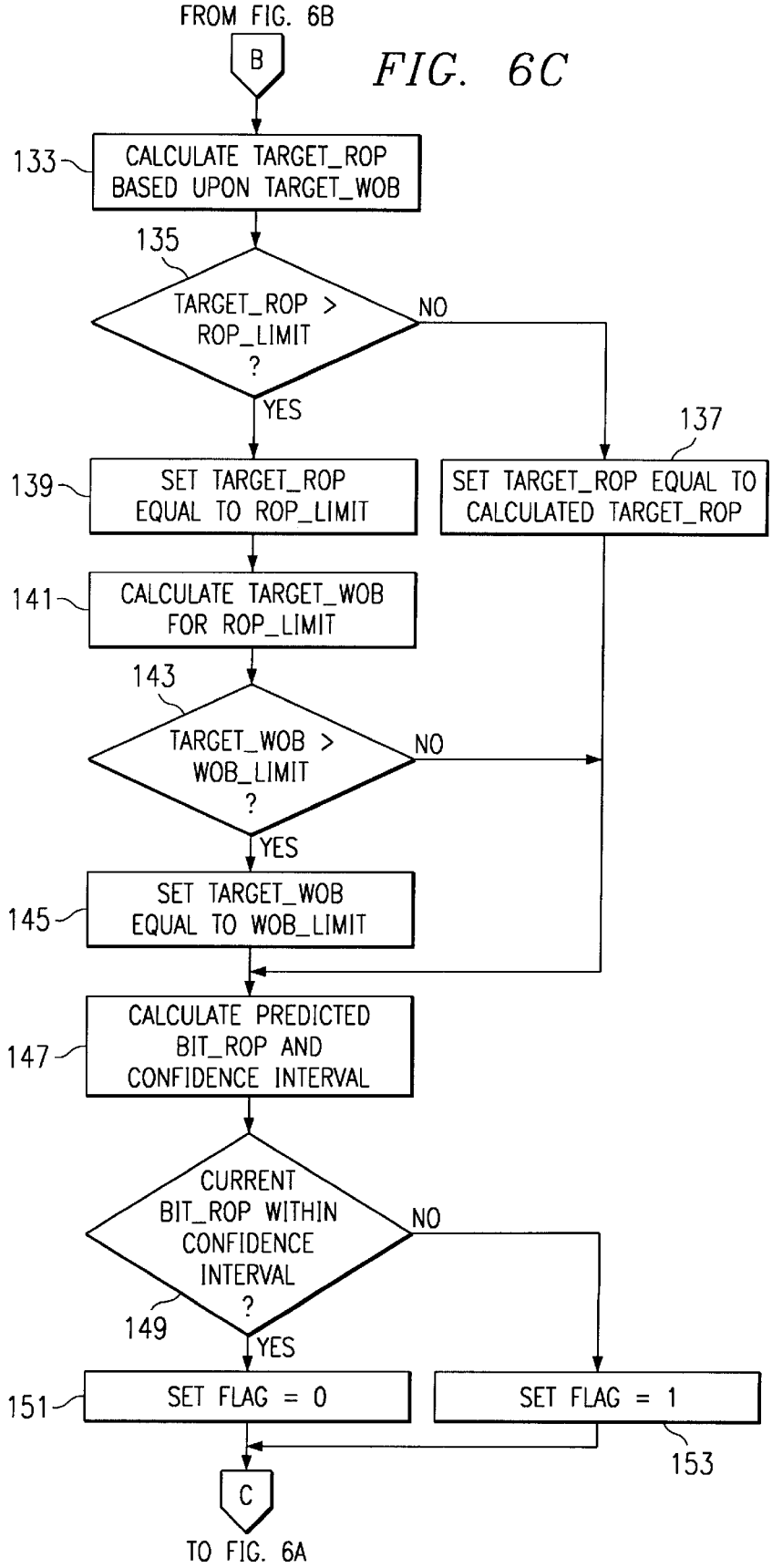
FROM FIG. 6B
B
FIG. 6C
133
CALCULATE TARGET_ROP BASED UPON TARGET_WOB
135
TARGET_ROP > ROP_LIMIT ?
NO
YES
137
139
SET TARGET_ROP EQUAL TO ROP_LIMIT
SET TARGET_ROP EQUAL TO CALCULATED TARGET_ROP
141
CALCULATE TARGET_WOB FOR ROP_LIMIT
143
TARGET_WOB > WOB_LIMIT ?
NO
YES
145
SET TARGET_WOB EQUAL TO WOB_LIMIT
147
CALCULATE PREDICTED BIT_ROP AND CONFIDENCE INTERVAL
CURRENT BIT_ROP WITHIN CONFIDENCE INTERVAL ?
NO
149
YES
151
SET FLAG = 0
SET FLAG = 1
153
C
TO FIG. 6A

METHOD OF AND SYSTEM FOR OPTIMIZING RATE OF PENETRATION IN DRILLING OPERATIONS

CROSS-REFERENCE-TO RELATED APPLICATION

The present application is a continuation of Ser. No. 09/053,955, filed Apr. 2, 1998, now U.S. Pat. No. 6,026,912 titled METHOD OF AND SYSTEM FOR OPTIMIZING RATE OF PENETRATION IN DRILLING OPERATIONS; which is a continuation-in-part of Ser. No. 09/158,338, filed Sep. 22, 1998, now U.S. Pat. No. 6,155,357, titled METHOD OF AND SYSTEM FOR OPTIMIZING RATE OF PENETRATION IN DRILLING OPERATIONS; which claims benefit of provisional application Ser. No. 60/059,794, filed Sep. 23, 1997, titled METHOD OF AND SYSTEM FOR OPTIMIZING RATE OF PENETRATION IN DRILLING OPERATIONS.

FIELD OF THE INVENTION

The present invention relates generally to earth boring and drilling, and more particularly to a method of and system for optimizing the rate of penetration in drilling operations.

Description of the Prior Art

It is very expensive to drill bore holes in the earth such as those made in connection with oil and gas wells. Oil and gas bearing formations are typically located thousands of feet below the surface of the earth. Accordingly, thousands of feet of rock must be drilled through in order to reach the producing formations.

The cost of drilling a well is primarily time dependent. Accordingly, the faster the desired penetration depth is achieved, the lower the cost in completing the well.

While many operations are required to drill and complete a well, perhaps the most important is the actual drilling of the bore hole. In order to achieve the optimum time of completion of a well, it is necessary to drill at the optimum rate of penetration. Rate of penetration depends on many factors, but a primary factor is weight on bit. As disclosed, for example in Millheim, et al., U.S. Pat. No. 4,535,972, rate of penetration increases with increasing weight on bit until a certain weight on bit is reached and then decreases with further weight on bit. Thus, there is generally a particular weight on bit that will achieve a maximum rate of penetration.

Drill bit manufacturers provide information with their bits on the recommended optimum weight on bit. However, the rate of penetration depends on many factors in addition to weight on bit. For example, the rate of penetration depends upon characteristics of the formation being drilled, the speed of rotation of the drill bit, and the rate of flow of the drilling fluid. Because of the complex nature of drilling, a weight on bit that is optimum for one set of conditions may not be optimum for another set of conditions.

One method for determining an optimum rate of penetration for a particular set of conditions is known as the "drill off test", disclosed, for example, in Bourdon, U.S. Pat. No. 4,886,129. In a drill off test, an amount of weight greater than the expected optimum weight on bit is applied to the bit. As the drill string is lowered into the borehole, the entire weight of the drill string is supported by the hook. The drill string is somewhat elastic and it stretches under its own weight. When the bit contacts the bottom of the borehole, weight is transferred from the hook to the bit and the amount of drill string stretch is reduced. While holding the drill string against vertical motion at the surface, the drill bit is rotated at the desired rotation rate and with the fluid pumps at the desired pressure. As the bit is rotated, the bit penetrates the formation. Since the drill string is held against vertical motion at the surface, weight is transfer from the bit to the hook as the bit penetrates the formation. By the application of Hooke's law, as disclosed in Lubinsky U.S. Pat. No. 2,688,871, the instantaneous rate of penetration may be calculated from the instantaneous rate of change of weight on bit. By plotting bit rate of penetration against weight on bit during the drill off test, the optimum weight on bit can be determined. After the drill off test, the driller attempts to maintain the weight on bit at that optimum value.

A problem with using a drill off test to determine an optimum weight on bit is that the drill off test produces a static weight on bit value that is valid only for the particular set of conditions experienced during the test. Drilling conditions are complex and dynamic. Over the course of time, conditions change. As conditions change, the weight on bit determined in the drill off test may no longer be optimum.

It is therefore an object of the present invention to provide a method and system for determining dynamically and in real time an optimum weight on bit to achieve an optimum rate of penetration for a particular set of conditions.

SUMMARY OF THE INVENTION

The present invention provides a method of and system for optimizing bit rate of penetration while drilling. The method of the present invention substantially continuously determines an optimum weight on bit necessary to achieve an optimum bit rate of penetration for the current drilling environment and maintains weight on bit at the optimum weight on bit. As the drilling environment changes while drilling, the method continuously updates the determination of optimum weight on bit.

The method substantially continuously collects bit rate of penetration and weight on bit data during drilling. The method stores bit rate of penetration and weight on bit data in a data array. Periodically, the method performs a linear regression of the data in the data array with bit rate of penetration as a response variable and weight on bit as an explanatory variable to produce a weight on bit coefficient.

The method periodically searches the data array to determine a maximum rate of penetration. The depth of search into the data array is dependent on the value of the weight on bit coefficient. The more positive the weight on bit coefficient, the greater the depth of search into the data array. If the weight on bit coefficient is strongly negative, the method searches only a small distance into the data array.

The method bases the optimum weight on bit determination on a selected number of weights on bit associated with the maximum rates of penetration within the depth of search and the weight on bit coefficient. The selected number depends on the depth of search. Generally, the greater the depth of search, the greater the selected number. If the selected number is greater than one, then the method averages the selected weights on bit to obtain a weight on bit value. If the weight on bit coefficient is in a selected range near zero, the method sets the optimum weight on bit at the weight on bit value. If the weight on bit coefficient is greater than a selected positive value, the method sets the optimum weight on bit at the weight on bit value plus a selected increment. If the weight on bit coefficient is less than a selected negative value, the method sets the optimum weight on bit at the weight on bit value minus a selected increment.

BRIEF DESCRIPTION OF THE DRAWING

FIG. 4 is a flowchart of data collection and generation according to the present invention.

FIG. 5 is a flowchart of display processing according to the present invention.

FIGS. 6A–6C comprise a flowchart of drilling model construction and rate of penetration processing according to the present invention.

FIG. 7 is a data array according to the present invention.

DESCRIPTION OF THE PREFERRED EMBODIMENT

Figure 1:
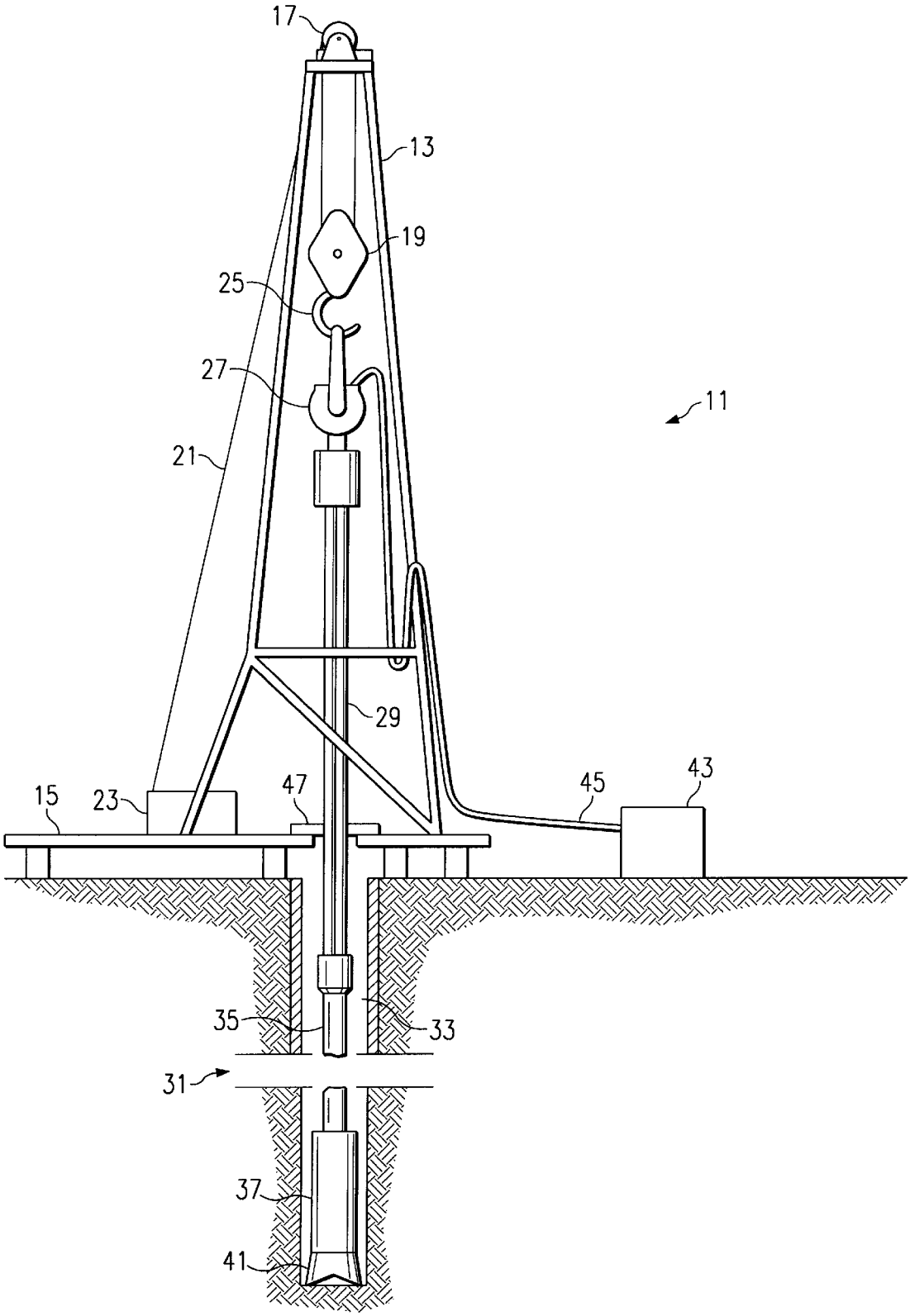
FIG. 1 is a pictorial illustration of a rotary drilling rig.

Referring now to the drawings and first to FIG. 1, a drilling rig is designated generally by the numeral 11. Rig 11 in FIG. 1 is depicted as a land rig. However, as will be apparent to those skilled in the art, the method and system of the present invention will find equal application to non-land rigs, such as jack-up rigs, semisubmersibles, drill ships, and the like. Also, although a conventional rotary rig is illustrated, those skilled in the art will recognize that the present invention is also applicable to other drilling technologies, such as top drive, power swivel, downhole motor, coiled tubing units, and the like.

Rig 11 includes a mast 13 that is supported on the ground above a rig floor 15. Rig 11 includes lifting gear, which includes a crown block 17 mounted to mast 13 and a traveling block 19. Crown block 17 and traveling block 19 are interconnected by a cable 21 that is driven by draw works 23 to control the upward and downward movement of traveling block 19. Traveling block 19 carries a hook 25 from which is suspended a swivel 27. Swivel 27 supports a kelly 29, which in turn supports a drill string, designated generally by the numeral 31 in a well bore 33. Drill string 31 includes a plurality of interconnected sections of drill pipe 35 a bottom hole assembly (BHA) 37, which includes stabilizers, drill collars, measurement while drilling (MWD) instruments, and the like. A rotary drill bit 41 is connected to the bottom of BHA 37.

Drilling fluid is delivered to drill string 31 by mud pumps 43 through a mud hose 45 connected to swivel 27. Drill string 31 is rotated within bore hole 33 by the action of a rotary table 47 rotatably supported on rig floor 15 and in nonrotating engagement with kelly 29.

Drilling is accomplished by applying weight to bit 41 and rotating drill string 31 with kelly 29 and rotary table 47. The cuttings produced as bit 41 drills into the earth are carried out of bore hole 33 by drilling mud supplied by mud pumps 43.

As is well known to those skilled in the art, the weight of drill string 31 is substantially greater than the optimum weight on bit for drilling. Accordingly, during drilling, drill string 31 is maintained in tension over most of its length above BHA 37. The weight on bit is equal to the weight of string 31 in the drilling mud less the weight suspended by hook 25.

Figure 2:
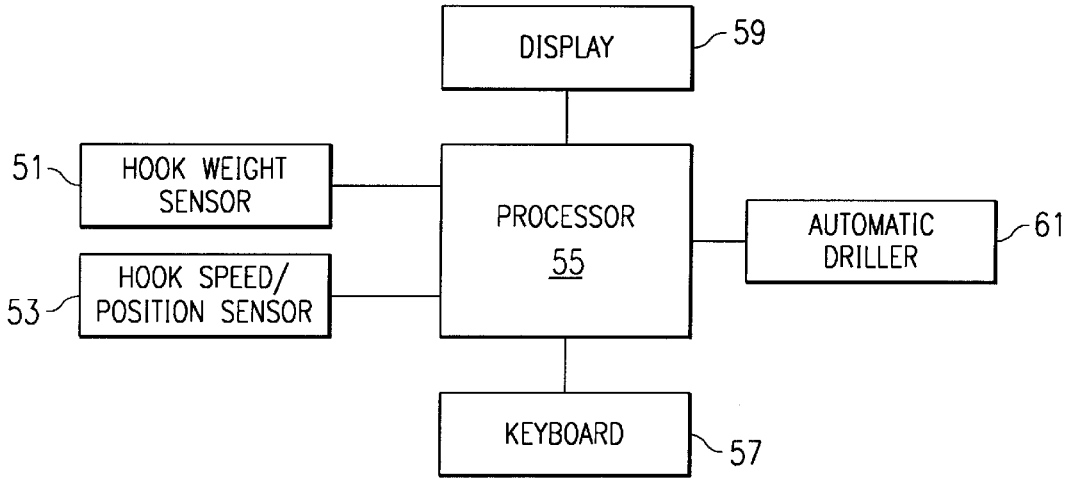
FIG. 2 is a block diagram of a system according to the present invention.

Referring now to FIG. 2, there is shown a block diagram of a preferred system of the present invention. The system includes a hook weight sensor 51. Hook weight sensors are well known in the art. They comprise digital strain gauges or the like, that produce a digital weight value at a convenient sampling rate, which in the preferred embodiment is five times per second although other sampling rates may be used. Typically, a hook weight sensor is mounted to the static line (not shown) of cable 21 of FIG. 1.

The weight on bit can be calculated by means of the hook weight sensor. As drill string 31 is lowered into the hole prior to contact of bit 41 with the bottom of the hole, the weight on the hook, as measured by the hook weight sensor, is equal to the weight of string 31 in the drilling mud. Drill string 31 is somewhat elastic. Thus, drill string 31 stretches under its own weight as it is suspended in well bore 33. When bit 41 contacts the bottom of bore hole 33, the stretch is reduced and weight is transferred from hook 25 to bit 41.

The driller applies weight to bit 41 effectively by controlling the height or position of hook 25 in mast 13. The driller controls the position of hook 25 by operating a brake to control the paying out cable from drawworks 23. Referring to FIG. 2, the system of the present invention includes a hook speed/position sensor 53. Hook speed sensors are well known to those skilled in the art. An example of a hook speed sensor is a rotation sensor coupled to crown block 17. A rotation sensor produces a digital indication of the magnitude and direction of rotation of crown block 17 at the desired sampling rate. The direction and linear travel of cable 21 can be calculated from the output of the hook position sensor. The speed of travel and position of traveling block 19 and hook 25 can be easily calculated based upon the linear speed of cable 21 and the number of cables between crown block 17 and traveling block 19.

In the manner well known to those skilled in the art, the rate of penetration (ROP) of bit 41 may be computed based upon the rate of travel of hook 25 and the time rate of change of the hook weight. Specifically, $BIT_ROP = HOOK_ROP + \Lambda(dF/dT)$, where BIT_ROP represents the instantaneous rate of penetration of the bit, HOOK_ROP represents the instantaneous speed of hook 25, $\Lambda$ represents the apparent rigidity of drill string 31 and $dF/dT$ represents the first derivative with respect to time of the weight on the hook.

In FIG. 2, each sensor 51 and 53 produces a digital output at the desired sampling rate that is received at a processor 55. Processor 55 is programmed according to the present invention to process data received from sensors 51 and 53. Processor 55 receives user input from user input devices, such as a keyboard 57. Other user input devices such as touch screens, keypads, and the like may also be used. Processor 55 provides visual output to a display 59. Processor 55 may also provide output to an automatic driller 61, as will be explained in detail hereinafter.

Figure 3:
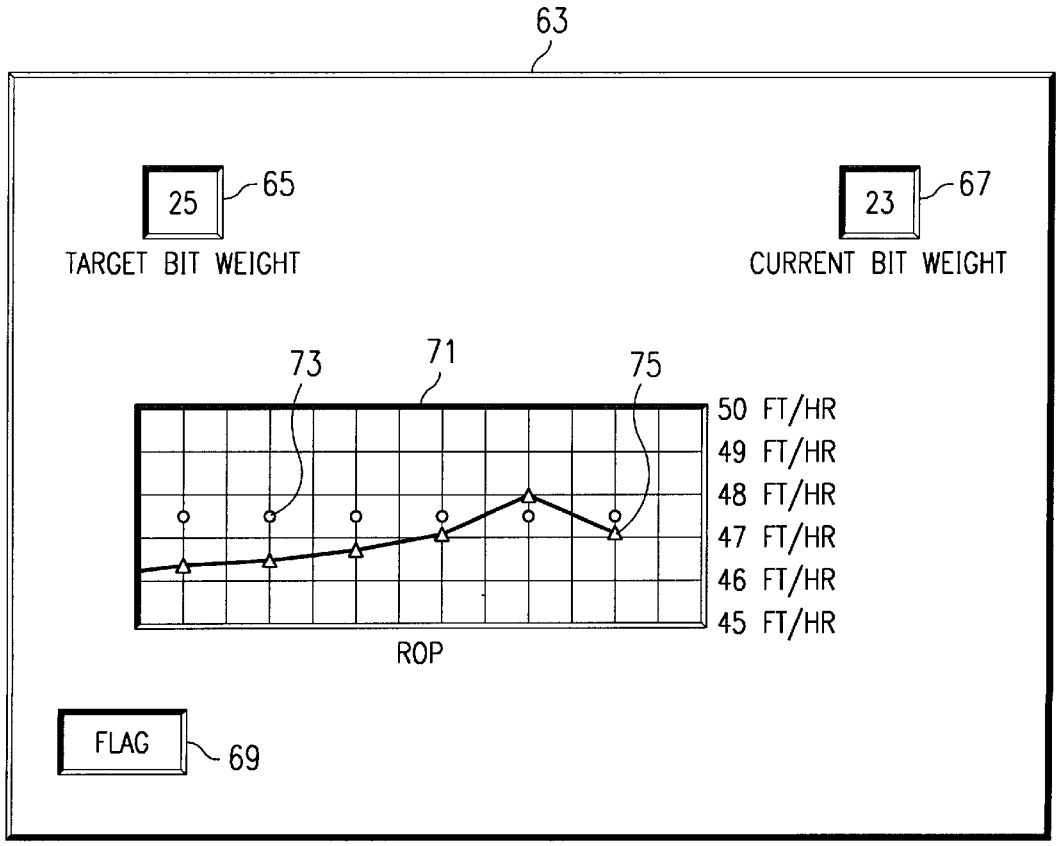
FIG. 3 is an illustration of a screen display according to the present invention.

Referring now to FIG. 3, a display screen according to the present invention is designated by the numeral 63. Display screen 63 includes a target bit weight display 65 and a current bit weight display 67. According to the present invention, a target bit weight in kilopounds is calculated to achieve a desired rate of penetration. Target bit weight display 65 displays the target bit weight computed according to the present invention. Current bit weight display 67 displays the actual current bit weight in kilopounds.

As will be explained in detail hereinafter, the method and system of the present invention constructs a mathematical model of the relationship between bit weight and rate of penetration for the current drilling environment. The mathematical model is built from data obtained from hook weight sensor 51 and hook speed/position sensor 53. The present invention calculates, based upon the model, a target bit weight, which is displayed in target bit weight display 65.

The system of the present invention continuously updates the model to reflect the current drilling conditions.

According to one aspect of the present invention, a driller attempts to match the value displayed in current bit weight display 67 with the value displayed in target bit weight display 65. According to another aspect of the present invention, the driller may turn control over to automatic driller 61. If the driller has turned control over to automatic driller 61, the driller continues to monitor display 63. If the model becomes invalid, then a flag 69 will be displayed.

Flag 69 indicates that the model does not match the current drilling environment. Accordingly, flag 69 indicates that the drilling environment has changed. The change may be a normal lithological transition from one rock type to another or the change may indicate an emergency or potentially catastrophic condition. When flag 69 is displayed, the driller is alerted to the change in conditions.

Display screen 63 also displays a moving plot 71 of rate of penetration. The target rate of penetration is indicated in plot 71 by circles 73 and the actual rate of penetration is indicated by triangles 75. By matching actual bit weight to target bit weight, the plot of actual rate of penetration, indicated by triangles 75, will be closely matched with the plot of target rate of penetration, indicated by circles 73.

Referring now to FIGS. 4–6, there are shown flow charts of processing according to the present invention. In the preferred embodiment, three separate processes run in a multitasking environment. Referring to FIG. 4, there is shown a flow chart of the data collection and generation process of the present invention. The system receives sampled hook rate of penetration (ROP) and hook weight values from sensors 51 and 53, at block 77. The preferred sampling rate for hook ROP and hook weight is five times per second. The system calculates average bit weight and BIT_ROP over a selected time period, which in the preferred embodiment is ten seconds, at block 79. Then, the system stores the average bit weight and bit ROP with a time value, at block 81 and returns to block 77.

Referring now to FIG. 5, there is shown display processing according to the present invention. The system displays the current average bit weight, which is calculated at block 79 of FIG. 4, at block 83. The system displays the current average bit ROP, which is also calculated at block 79 of FIG. 4, at block 85. The system displays a target bit ROP at block 87. The target bit ROP is based upon what has been observed and upon what is feasible under the applicable conditions. The system displays the current target bit weight at block 89. Current target bit weight is a calculated value, the calculation of which will be explained in detail hereinafter.

The system tests, at decision block 91, if a flag is set to zero. As will be described in detail hereinafter, the flag is set to one whenever an observed bit rate of penetration does not fit the model. If, at decision block 91, the flag is not equal to zero, then the system displays the flag (flag 69 of FIG. 3) at block 93, and processing continues at block 83. If, at decision block 91, the flag is set to zero, then display processing returns to block 83.

Figure 6A:
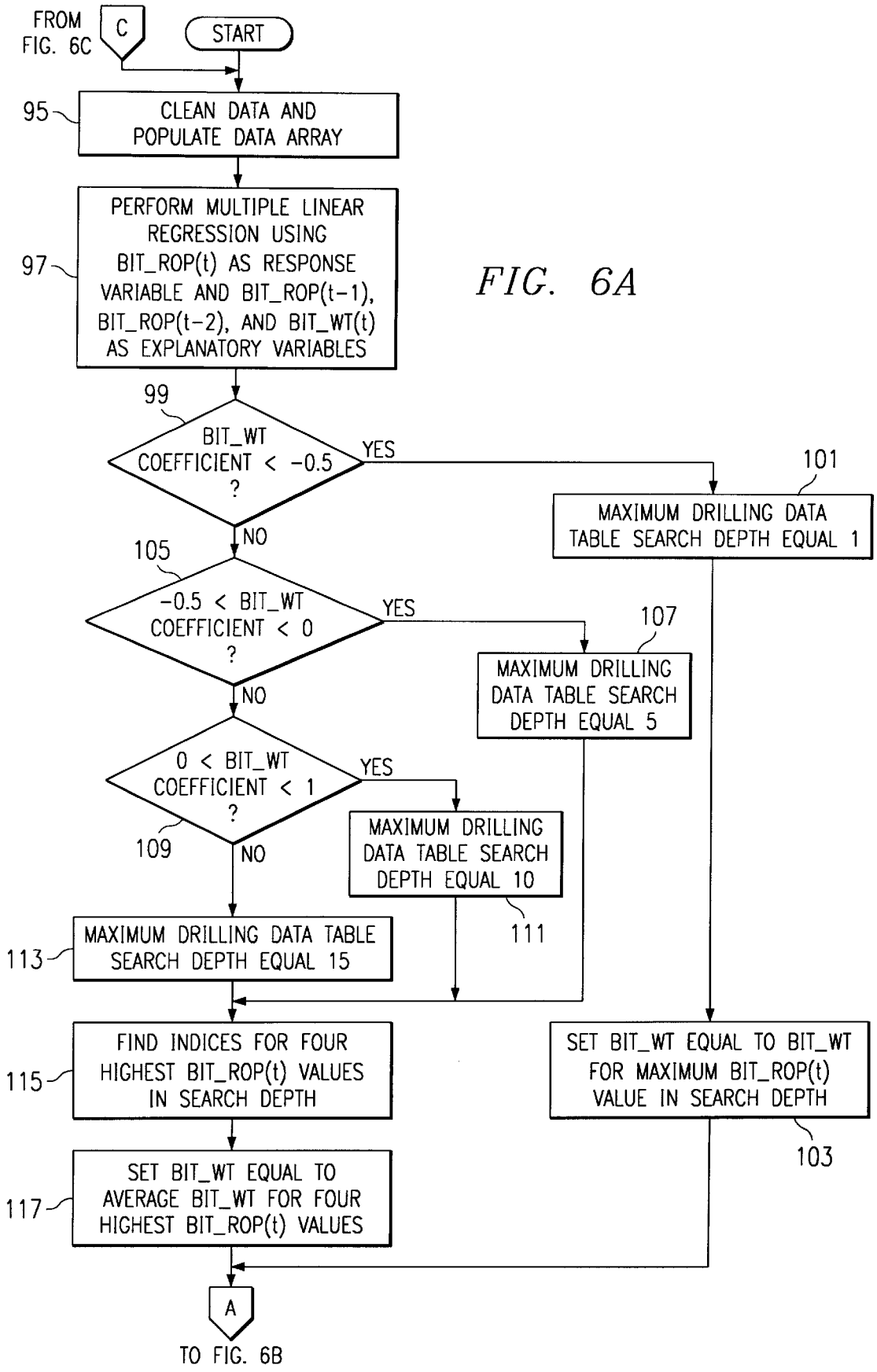

Referring now to FIG. 6 and particularly to FIG. 6A, there is shown a flow chart of the building of a drilling model and calculation of target rate or penetration and weight on bit according to the present invention. In the preferred embodiment, FIG. 4 processing is performed once each ten seconds. First, the system cleans the data stored according to FIG. 4 processing and populates a data array, at block 95. Data cleaning involves removing zeros and outliers from the data. The clean data are stored in a data array as illustrated in FIG. 7.

Referring to FIG. 7, the data array includes an index column 99, a bit weight column 101, and a bit ROP column 103. Columns 99–103 are populated with data from data cleaning step 97. The data array of FIG. 7 also includes a first lagged bit ROP column 105 and a second lagged bit ROP column 107. The first lagged bit rate of penetration is denoted BIT_ROP(t−1) and the second lagged bit rate of penetration is denoted BIT_ROP(t−2). In the preferred embodiment, the data array of FIG. 7 holds up to thirty entries. Thus, the data array contains data for the last five minutes of drilling.

After populating the data array with clean data, at block 85, the system performs multilinear regression analysis using BIT_ROP(t) as the response variable and BIT_ROP (t−1), BIT_ROP(t−2) and BIT_WT(t) as the explanatory variables, at block 97. Multiple linear regression is a well known technique and tools for performing multilinear regression are provided in commercially available spreadsheet programs, such as Microsoft® Excel® and Corel® Quattro Pro®. Multiple linear regression produces the mathematical model of the drilling environment, which is an equation of the form:

$$\text{BIT_ROP}(t)=\alpha+\beta_1\text{BIT_ROP}(t-1)+\beta_2\text{BIT_ROP}(t-2)+\beta_3\text{BIT_WT}(t), \quad (1)$$

where $\alpha$ is the intercept, $\beta_1$ and $\beta_2$ are lagged BIT_ROP coefficients and $\beta_3$ is the BIT_WT coefficient.

After the system has performed multilinear regression at block 97, the system searches for a potential optimum weight on bit based upon the BIT_WT coefficient $\beta_3$. BIT_WT coefficient $\beta_3$ represents the slope of the line in the hyper-plane that relates weight on bit to bit rate of penetration. In the neighborhood around the optimum weight on bit, the slope $\beta_3$ is about equal to zero. Thus, it is goal of the present invention drill such that BIT_WT coefficient $\beta_3$ is close to zero. However, negative BIT_WT coefficients $\beta_3$ are avoided. The greater the BIT_WT coefficient $\beta_3$, the further the system searches into the data array to find a potential optimum weight on bit.

The system tests, at decision block 99, if BIT_WT coefficient $\beta_3$ is strongly negative, which in the preferred embodiment is less than negative 0.5. If so, the system sets the maximum data array search depth at one, at block 101. Then the system sets bit weight BIT_WT equal to the BIT_WT corresponding to the maximum BIT_ROP value in the search depth, at block 103. Since the search depth is one, there is only one candidate BIT_WT. If the BIT_WT coefficient $\beta_3$ not strongly negative, the system tests, at decision block 105, if the BIT_WT coefficient $\beta_3$ is weakly negative, which in the preferred embodiment is between zero and negative 0.5. If so, the system sets the maximum data array search depth equal to five, at block 107. If not, the system tests, at decision block 109, if the BIT_WT coefficient $\beta_3$ is weakly to moderately positive, which in the preferred embodiment is between zero and one. If so, the system sets the maximum data array search depth equal to ten, at block 111. If not, which indicates that the BIT_WT coefficient $\beta_3$ is strongly positive, the system sets the maximum data array search depth equal to fifteen, at block 113. Then, the system uses the maximum data array search depth set at blocks 107, 111, or 113 to find the indices with the four highest BIT_ROP(t), at block 115. Then the system sets the BIT_WT equal to the average BIT_WT(t) for the four highest BIT_ROP(T) values, at block 117.

The system then uses the BIT_WT value determined at block 103 or block 117 to determine a target weight on bit TARGET_WOB based upon the BIT_WT coefficient $\beta_3$.

Figure 6B:
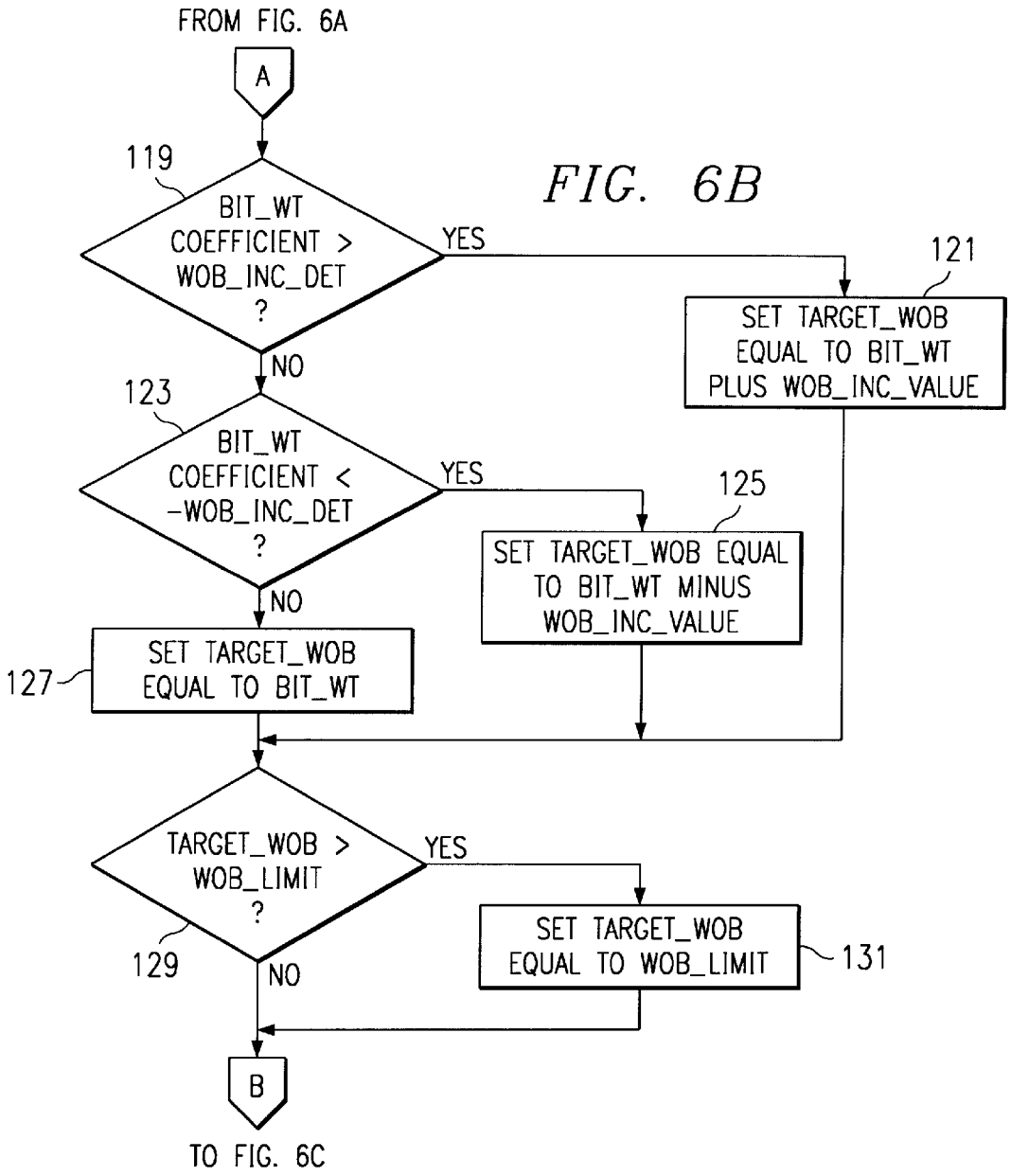

Referring to FIG. 6B, the system tests, at decision block 119, if BIT_WT coefficient $\beta_3$ is greater than a positive weight on bit incrementer determiner. The incrementer determiner is selected to keep the BIT_WT coefficient $\beta_3$ in the neighborhood of zero. In the preferred embodiment, the incrementer determiner is 0.15. If the BIT_WT coefficient $\beta_3$ is greater than the incrementer determiner, then the system sets the target weight on bit TARGET_WOB equal to the BIT_WT determined at blocks 103 or 117 plus a weight on bit increment value WOB_INC_VALUE, at block 121. In the preferred embodiment, WOB_INC_VALUE is equal to one thousand pounds. If not, the system tests, at decision block 123, if BIT_WT coefficient $\beta_3$ is less (more negative) than the negative weight on bit incrementer determiner. If so, the system sets the target weight on bit TARGET_WOB equal to the BIT_WT determined at blocks 103 or 117 minus the weight on bit increment value WOB_INC_VALUE, at block 125. If the BIT_WT coefficient $\beta_3$ is between the positive weight on bit incrementer determiner and the negative weight on bit incrementer determiner, the system sets, at block 127, TARGET_WOB equal to the BIT_WT determined at blocks 103 or 117.

The target weight on bit determined at blocks 121, 125, or 127, may be higher than a preset weight on bit limit WOB_LIMIT. WOB_LIMIT is set according to engineering and mechanical considerations. The system tests, at decision block 129, if TARGET_WOB is greater than the WOB_LIMIT. If so, the system sets TARGET_WOB equal to the WOB_LIMIT 131.

Referring now to FIG. 6C, after determining TARGET_WOB, the system calculates a target rate of penetration TARGET_ROP based upon TARGET_WOB and the model of equation (1), at block 133. There are engineering reasons for limiting rate of penetration. For example, the drilling fluid system may be able to remove cuttings at a certain rate. Drilling above a certain rate of penetration may produce cuttings at a rate greater than the ability of the fluid system to remove them. Accordingly, in the present invention there is a preset rate of penetration limit ROP_LIMIT. ROP_LIMIT may be the theoretical maximum rate of penetration, or some percentage, for example 95%, of the theoretical maximum. The system tests, at decision block 135, if the TARGET_ROP is greater than the ROP_LIMIT. If not, the system sets the TARGET_ROP equal to the calculated TARGET_ROP, at block 137. If the calculated TARGET_ROP is greater than the ROP_LIMIT, then the system sets the TARGET_ROP equal to the ROP_LIMIT, at block 139. Then the system calculates a TARGET_WOB based upon the ROP_LIMIT and the model of equation (1), at block 141, and tests, at decision block 143, if the TARGET_WOB calculated at block 141 is greater than WOB_LIMIT. If so, the system sets TARGET_WOB equal to the WOB_LIMIT, at block 145.

After completing steps 137 or 145, the system calculates a predicted BIT_ROP(t) and confidence interval at block 147. The forecasted BIT_ROP(t) is calculated by solving equation (1) for the actual current bit weight BIT_WT(t), BIT_ROP(t−1), BIT_ROP(t−2). The system tests, at decision block 149, if the current BIT_ROP is within the confidence interval. If so, the system sets the flag to zero at block 151 and processing returns to block 95 of FIG. 6A. If, at decision block 149, the current BIT_ROP is not within the confidence interval, the system sets the flag to 1, at block 153.

From the foregoing, it may be seen that the present invention is well adapted to overcome the shortcomings of the prior art. The system of the present invention builds a mathematical model of the relationship between weight on bit and rate of penetration for the current drilling environment. The system continuously updates the mathematical model to reflect changes in the drilling environment. The system uses a drilling model to determine a target weight on bit to produce an optimum rate of penetration. The driller attempts to match the actual weight on bit to the target weight on bit.

What is claimed is:

1. A method of optimizing bit rate of penetration while drilling, which comprises the steps of:

substantially continuously collecting bit rate of penetration and weight on bit data during drilling;

storing bit rate of penetration and weight on bit data in a data array;

periodically determining a weight on bit coefficient by performing a linear regression of the data in said data array with a bit rate of penetration as a response variable and weight on bit as an explanatory variable;

periodically searching said data array to determine at least one maximum rate of penetration; and, setting a target weight on bit based upon said at least one maximum rate of penetration and said weight on bit coefficient.

2. The method as claimed in claim 1, where in said step of setting a target weight on bit includes the step of:

setting said target weight on bit at the weight on bit associated with said at least one maximum rate of penetration in said data array if said weight on bit coefficient is greater than a particular negative value and less than a particular positive value.

3. The method as claimed in claim 1, wherein said step of setting a target weight on bit includes the step of:

setting said target weight on bit at the weight on bit associated with said at least one maximum rate of penetration in said data array plus an increment if said weight on bit coefficient is greater than a particular positive value.

4. The method as claimed in claim 1, wherein said step of setting a target weight on bit includes the step of:

setting said target weight on bit at the weight on bit associated with said at least one maximum rate of penetration in said data array minus an increment if said weight on bit coefficient is less than a particular negative value.

5. The method as claimed in claim 1, wherein said step of periodically searching said data array includes the steps of:

determining a depth of search based upon said weight on bit coefficient; and, searching said data array to said depth of search.

6. The method as claimed in claim 5, wherein said step of periodically searching said data array includes the step of determining a number of maximum rates of penetration within said depth of search.

7. The method as claimed in claim 6, including the steps of:

determining the weight on bit associated in said data array with each of said number of maximum rates of penetration within said number of maximum rates of penetration with said depth of search; and, averaging said weights on bit associated with said number of maximum rates of penetration to determine an average weight on bit.

8. The method as claimed in claim 7, wherein said step of setting a target weight on bit includes the step of:

setting said target weight on bit at said average weight on bit if said weight on bit coefficient is greater than a particular negative value and less than a particular positive value.

9. The method as claimed in claim 7, wherein the step of setting a target weight on bit includes the step of:

setting said target weight on bit at said average weight on bit plus an increment if said weight on bit coefficient is greater than a particular positive value.

10. The method as claimed in claim 7, wherein said step of setting a target weight on bit includes the step of:

setting said target weight on bit at the weight on bit associated with said average weight on bit minus an increment if said weight on bit coefficient is less than a particular negative value.

11. A method of optimizing bit rate of penetration while drilling, which comprises the steps of:

substantially continuously collecting bit rate of penetration and weight on bit data during drilling;

storing bit rate of penetration and weight on bit data in a data array;

periodically determining a weight on bit coefficient defined by a relationship between said bit rate of penetration and said weight on bit data stored in said data array;

periodically searching said data array to a depth of search related to said weight on bit coefficient;

determining at least one maximum rate of penetration within said depth of search; and setting an a target weight on bit based upon said at least one maximum rate of penetration and said weight on bit coefficient.

12. The method as claimed in claim 11, wherein said step of setting a target weight on bit includes the step of:

setting said target weight on bit at the weight on bit associated with said at least one maximum rate of penetration in said data array if said weight on bit coefficient is greater than a particular negative value and less than a particular positive value.

13. The method as claimed in claim 11, wherein said step of setting a target weight on bit includes the step of:

setting said target weight on bit at the weight on bit associated with said at least one maximum rate of penetration in said data array plus an increment if said weight on bit coefficient is greater than a particular positive value.

14. The method as claimed in claim 11, wherein said step of setting a target weight on bit includes the step of:

setting said target weight on bit at the weight on bit associated with said at least one maximum rate of penetration in said data array minus an increment of said weight on bit coefficient is less than a particular negative value.

15. The method as claimed in claim 11, wherein said step of periodically searching said data array includes the step of determining a number of maximum rates of penetration within said depth of search.

16. The method as claimed in claim 15, including the steps of:

determining the weight bit associated in said data array with each of said number of maximum rates of penetration within said depth of search; and, averaging said weights on bit associated with said number of maximum rates of penetration to determine an average weight on bit.

17. The method as claimed in claim 16, wherein said step of setting a target weight on bit includes the step of:

setting said target weight on bit at said average weight on bit if said weight on bit coefficient is greater than a selected negative value and less than a selected positive value.

18. The method as claimed in claim 16, wherein said step of setting a target weight on bit includes a step of: setting said target weight on bit at said average weight on bit plus an increment if said weight on bit coefficient is greater than a particular positive value.

19. The method as claimed in claim 16, wherein said step of setting a target weight on bit includes the step of:

setting said target weight on bit at the weight on bit associated with said average weight on bit minus an increment if said weight on bit coefficient is less than a particular negative value.

* * * * *